US006565376B2

(12) United States Patent
Aoki

(10) Patent No.: US 6,565,376 B2
(45) Date of Patent: May 20, 2003

(54) FLAT CABLE TERMINAL

(75) Inventor: Hiroshi Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/785,394

(22) Filed: Feb. 20, 2001

(65) Prior Publication Data

US 2001/0016449 A1 Aug. 23, 2001

(30) Foreign Application Priority Data

Feb. 18, 2000 (JP) ..... 2000-041500

(51) Int. Cl.[7] ..... H01R 4/24
(52) U.S. Cl. ..... 439/422; 439/442; 439/877
(58) Field of Search ..... 439/422, 421, 439/423, 424, 417, 418, 442, 877

(56) References Cited

U.S. PATENT DOCUMENTS 3,395,381 A * 7/1968 Huggnagle ..... 439/422
3,715,457 A * 2/1973 Teagno et al. ..... 174/88 R
3,960,430 A * 6/1976 Bunnell et al. ..... 439/422
4,106,836 A * 8/1978 Asick et al. ..... 439/422
4,669,798 A * 6/1987 Daum et al. ..... 439/423
5,137,468 A * 8/1992 Murakami ..... 439/422
5,611,709 A * 3/1997 McAnulty ..... 439/422

FOREIGN PATENT DOCUMENTS

JP 10-275642 10/1998 ..... H01R/9/07

* cited by examiner

*Primary Examiner*—P. Austin Bradley
*Assistant Examiner*—Ross Gushi

(57) ABSTRACT

A bottom plate portion (3) of a flat cable terminal (1) is partially cut to form at least one spring piece portion (6). The at least one spring piece portion (6) is upwardly raised relative to the bottom plate portion (3). At least one barrel (4) pierces a base sheet (42) of a FPC (40) in a thickness direction thereof, and is so folded that a conductor (41) formed on the base sheet (42) of the FPC (40) is pressed and held between the at least one barrel (4) and the at least one spring piece portion (6). A fine projection (7) is formed on the spring piece portion (6) in order to firmly press against the conductor (41) of the FPC (40). A distal end of the barrel (4) is chamfered so as to facilitate penetration of the barrel (4) relative to the base sheet (42) of the FPC (40).

20 Claims, 5 Drawing Sheets

FLAT CABLE TERMINAL

BACKGROUND OF THE INVENTION

1. Field of the Invention

The present invention relates to a terminal for a flat cable which is excellent in electrical connectability, and can achieve an enhanced efficiency of a connecting operation.

The present application is based on Japanese Patent Application No. 2000-41500, which is incorporated herein by reference.

2. Description of the Related Art

Various flat cable terminals have heretofore been proposed.

FIGS. 5 and 6 show one such terminal disclosed, for example, in Unexamined Japanese Patent Publication No. Hei. 10-275642. This flat cable terminal 51 is formed by bending a single metal sheet, and includes a male terminal portion 52, formed at one end of a base 53*a* of a strip-like shape, a bottom plate portion 53, formed at the other longitudinal end portion of the base 53*a* so as to support a flat cable 40 thereon, and a plurality of barrels 54 which extend from opposite side edges of the bottom plate portion 53 in a direction substantially perpendicular to the direction of the length of the base 53*a,* and can be curved inwardly into a substantially-cylindrical shape so that these barrels 54 can press the flat cable 40 against the bottom plate portion 53 by their outer peripheral surfaces.

In this terminal 51, recesses 55 are formed respectively in those portions of the bottom plate portion 53 corresponding respectively to the barrels 54, and are recessed in a direction substantially perpendicular to the direction of the length of the base 53*a* as shown in FIG. 6, each of the recesses 55 having substantially the same curvature as that of the distal end portion of the curved barrel 54. Thanks to the provision of these recesses 55, the barrels 54, pressed against the flat cable 40, are kept retained respectively in the recesses 55 even when an external tensile load acts on the flat cable 40 in the longitudinal direction, and therefore the cable 40 is prevented from being disengaged from the terminal 51. And besides, each recess 55 serves to increase the area of contact between the outer peripheral surface of the barrel 54 and the cable 40, thereby enhancing the reliability of the electrical connection.

The flat cable 40 has a plurality of juxtaposed elongate conductors 41 (serving as circuit members) formed on a base sheet 42 which is comprised of, for example, an insulative resin film. For connecting the terminal 51 to the flat cable 40, a distal end portion of the flat cable 40 to be connected to the terminals 51 is processed into juxtaposed rectangular sections by cutting off those portions of the base sheet 42 each disposed between the adjacent conductors 41. Then, the distal end portion of the cable, thus divided into the sections each having the conductor 41 formed thereon, is placed on the bottom plate portions 43 of the terminals 51, and in this condition the barrels 54 of each terminal are pressed to be deformed, thereby achieving the above connection. The flat cable 40 is pressed and held between each recess portion 55, formed in the bottom plate portion 53, and the outer peripheral surface of the corresponding barrel 54, and therefore is electrically and mechanically connected to the terminal 51.

In the above conventional flat cable terminal 51, however, it is necessary to strictly control the curved shape and height of the barrels 54 in order that the contacted condition of the barrels 54 can always be made stable so as to achieve the good press-contact thereof with the flat cable 40 even when the conductor 41 and the base sheet 42 are changed in thickness. However, it has been difficult to strictly control the curved shape and height of the barrels 54. Therefore, there was encountered a problem that the mechanical and electrical connection of the barrel to the cable 40 was weak, or was too strong, so that the cable was disengaged and damaged.

And besides, for connecting the terminals 51 to the distal end portion of the flat cable 40, this distal end portion must be processed into the juxtaposed rectangular sections, and this invited a problem that the efficiency of the connecting operation was low.

SUMMARY OF THE INVENTION

The present invention has been made under the above circumstances, and an object of the present invention is to provide a flat cable terminal which can always achieve a stable mechanical and electrical connection with a predetermined contact load, and can achieve an enhanced efficiency of a connecting operation.

To achieve the above object, according to the first aspect of the present invention, there is provided a terminal which comprises a bottom plate portion onto which a flat cable is attachable, at least one barrel formed on the bottom plate portion, and at least one resilient piece portion resiliently deformable on the bottom plate portion, wherein the bottom plate portion is partially cut to form the at least one resilient piece portion, wherein the at least one resilient piece portion is upwardly raised relative to the bottom plate portion, and wherein the at least one barrel pierces a base sheet of the flat cable in a thickness direction thereof, and is so folded that a conductor formed on the base sheet of the flat cable is pressed and held between the at least one barrel and the at least one resilient piece portion.

The flat cable is placed on the bottom plate portion, with the conductor of the flat cable opposed to the bottom plate portion. Then, when the flat cable is pressed toward the bottom plate portion, the barrel pierces the base sheet of the flat cable in the thickness direction thereof, and projects from the rear surface of the flat cable. Then, when the barrel is bent and folded inwardly relative to the bottom plate portion, the flat cable is resiliently held between the barrel and the corresponding resilient piece portion.

According to the second aspect of the present invention, it is preferable that a fine projection is formed on the at least one resilient piece portion in order to firmly press against the conductor of the flat cable. Accordingly, the terminal can be positively electrically connected to the conductor even if the bent barrel is not always held in substantially parallel relation to the bottom plate portion.

According to the third aspect of the present invention, it is preferable that a distal end of the at least one barrel is chamfered so as to facilitate penetration of the at least one barrel relative to the base sheet of the flat cable. That is, the barrel can easily pierce the base sheet of the flat cable.

According to the fourth aspect of the present invention, it is preferable that the at least one barrel has a substantially parabolic shape, so that the at least one barrel can more easily pierce the base sheet of the flat cable.

According to the fifth aspect of the present invention, it is preferable that the flat cable is held between the at least one barrel and the at least one resilient piece portion, so that the at least one resilient piece portion is electrically connected to the conductor of the flat cable.

According to the sixth aspect of the present invention, the conductor of the flat cable may be arranged along a longitudinal direction of the bottom plate portion.

According to the seventh aspect of the present invention, it is preferable that the at least one resilient piece portion is disposed correspondingly to the at least one barrel.

According to the eighth aspect of the present invention, a proximal end of the at least one resilient piece portion may be located adjacent to a proximal end of the at least one barrel.

According to the ninth aspect of the present invention, it is preferable that the at least one resilient piece portion is formed on the bottom plate portion in a cantilever manner.

According to the tenth aspect of the present invention, the terminal may further comprises a terminal body, and a terminal portion formed at a first end portion of the terminal body, wherein the bottom plate portion is formed at a second end portion of the terminal body.

According to the eleventh aspect of the present invention, the plurality of barrels may be arranged on opposite side edges of the bottom plate portion in a staggered manner. In this case, the plurality of resilient piece portions are preferably disposed correspondingly to the plurality of barrels, respectively.

According to the twelfth aspect of the present invention according to the eleventh aspect, proximal ends of the plurality of resilient piece portions may be respectively located adjacent to proximal ends of the plurality of barrels.

DETAILED DESCRIPTION OF THE PREFERRED EMBODIMENT

Figure 1:
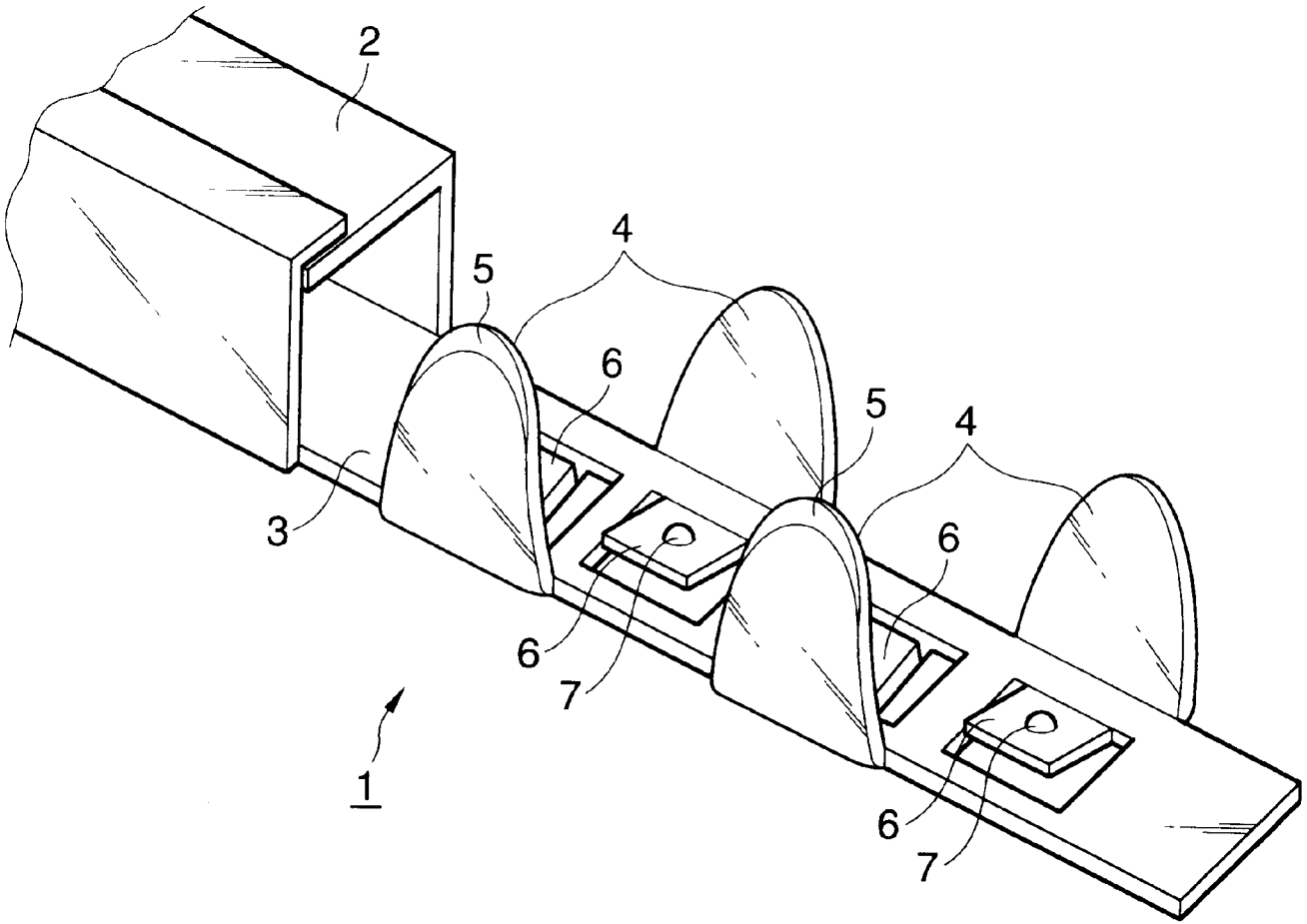
FIG. 1 is a perspective view of one preferred embodiment of a flat cable terminal of the present invention, showing a condition before this terminal is connected.
Figure 2:
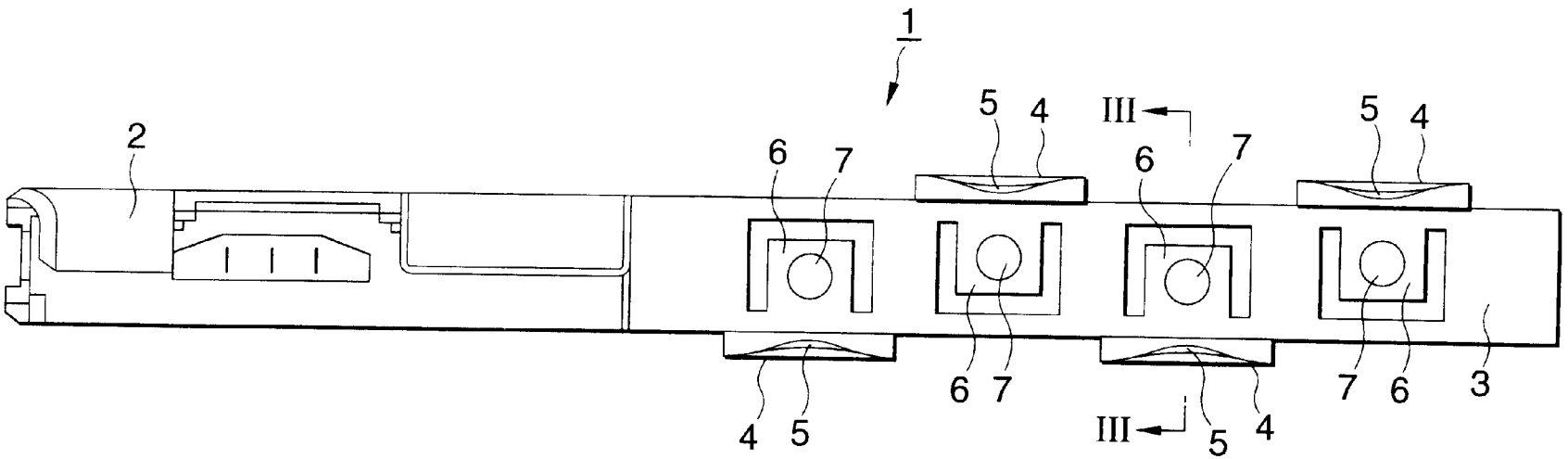
FIG. 2 is a plan view of the terminal of FIG. 1.
Figure 3:
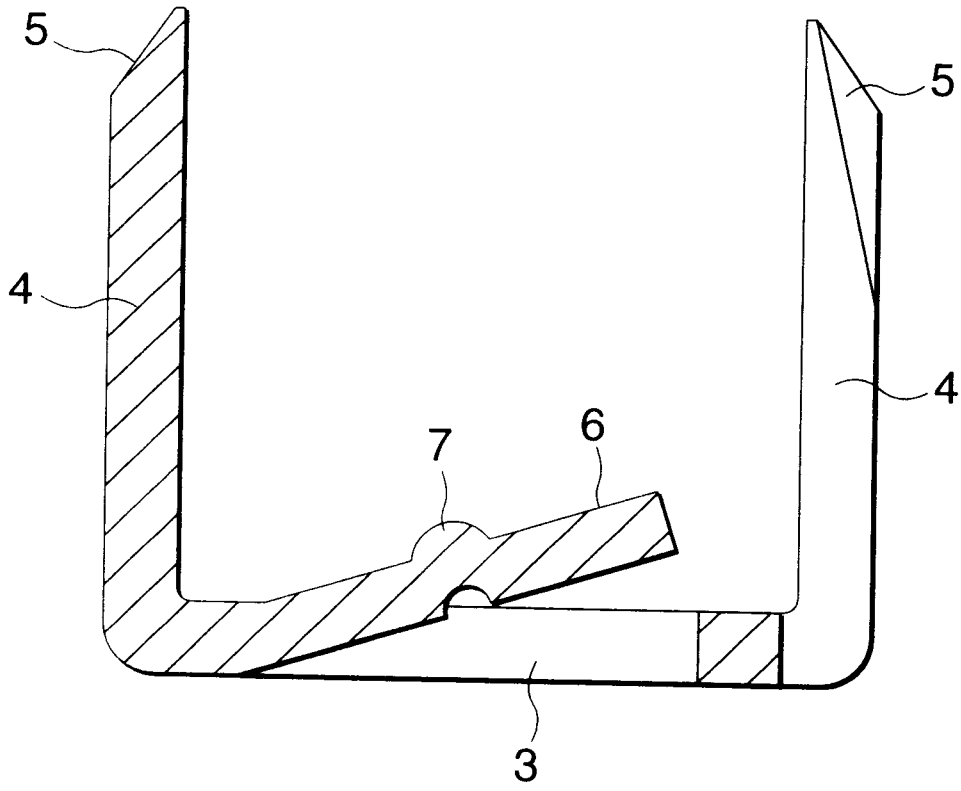
FIG. 3 is a cross-sectional view taken along the line III—III of FIG. 2.
Figure 4:
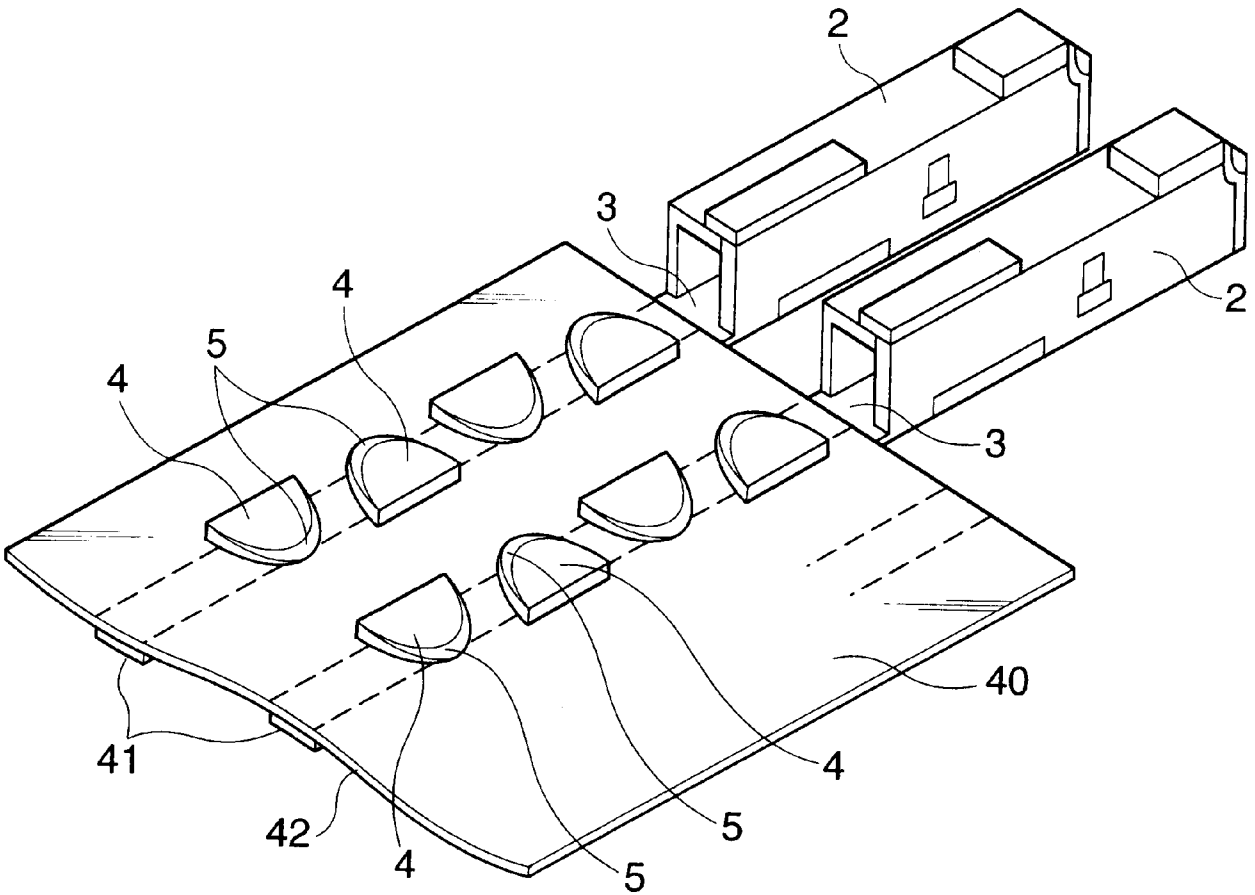
FIG. 4 is a perspective view showing a condition in which the flat cable terminals of FIG. 1 are connected to a flat cable.
Figure 5:
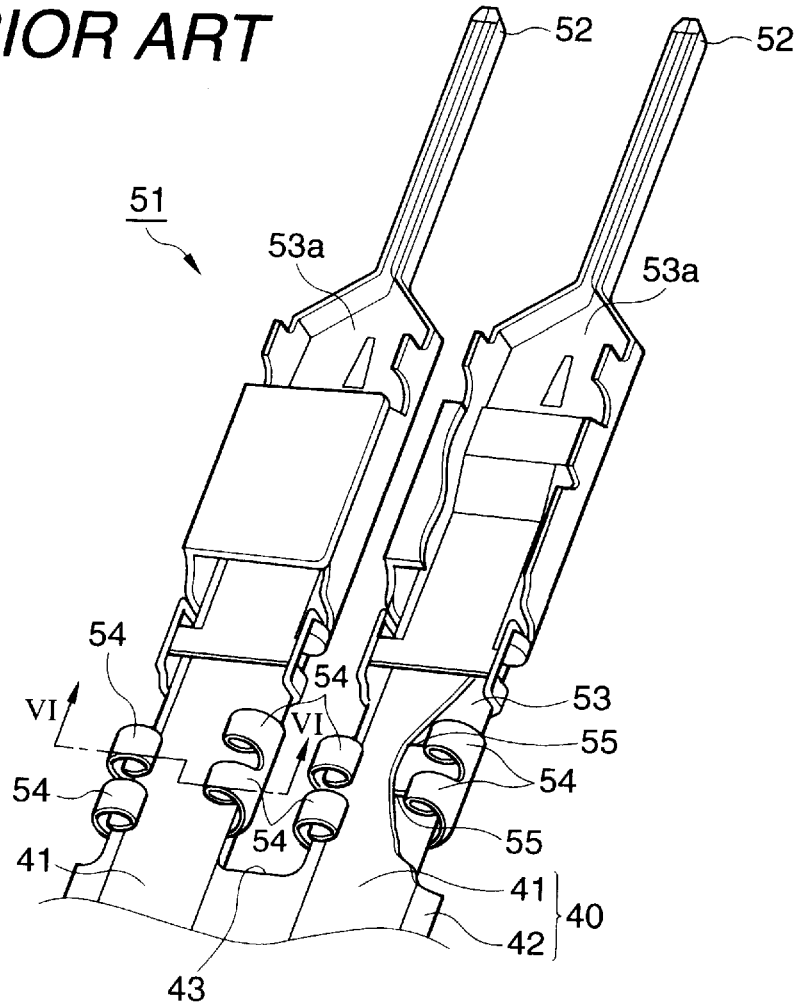
FIG. 5 PRIOR ART
FIG. 5 is a perspective view showing a condition in which a conventional flat cable terminals are connected to a flat cable.
Figure 6:
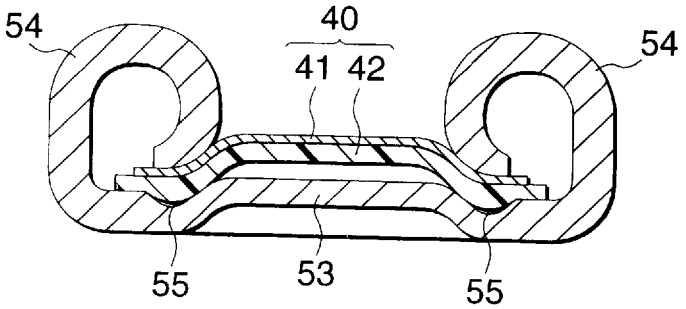
FIG. 6 PRIOR ART
FIG. 6 is a cross-sectional view taken along the line VI—VI of FIG. 5.

A preferred embodiment of a flat cable terminal of the present invention now will be described in detail with reference to FIGS. 1 to 4.

In this embodiment, a flexible printed circuit board (hereinafter referred to as "FPC") is used as the flat cable, and this FPC comprises an insulative resin film, and circuit conductors formed by etching a metal foil, formed on this film, into a predetermined pattern.

In FIGS. 1 to 4, the flat cable terminal 1 is formed by bending a single metal sheet, and includes a female terminal portion 2, formed at one end thereof, a bottom plate portion 3, formed at the other end portion thereof so as to support the FPC 40 thereon, and a plurality of barrels 4 which extend from opposite side edges of the bottom plate portion 3 in a direction substantially perpendicular to the direction of the length of the bottom plate portion 3, and can be bent and folded inwardly in opposed relation to the bottom plate portion 3 on which the FPC 40 is placed.

The barrels 4, formed on the opposite side edges of the bottom plate portion 3, are arranged in a staggered manner (or a zigzag fashion) in the longitudinal direction. That is, the barrels 4 on the right side edge and the barrels 4 on the left side edge are arranged alternately. The barrels 4 extend perpendicularly from the opposite side edges of the bottom plate portion 3 so as to pierce a base sheet 42 in a direction of a thickness thereof to be arranged along a conductor 41 of the FPC 40 placed on the bottom plate portion 3.

Those portions of the bottom plate portion 3, corresponding respectively to the barrels 4, are stamped from the bottom plate portion 3, and are raised to respectively provide spring piece portions 6 for resilient contact with the conductor 41 of the FPC 40 placed on the bottom plate portion 3, each of the spring piece portions 6 having a proximal end disposed in registry with the corresponding barrel 4.

A fine projection 7 for being firmly pressed against the conductor 41 is formed on the spring piece portion 6. A chamfered, slanting piercing surface 5 for enabling the barrel 4 to easily pierce the base sheet 42 in the direction of the thickness thereof is formed on an outer surface of the barrel 4 at a distal end thereof. The barrel 4 has a substantially parabolic shape in its developed condition so that it can more easily pierce the base sheet 42 in the direction of the thickness thereof.

For connecting the FPC 40 to the flat cable terminal 1, the terminal 1 is so arranged that the conductor 41 can overlie the bottom plate portion 3 except the terminal portion 2, and then the cable surface of the FPC 40 is directed toward the terminal 1, and the FPC 40 is placed on the terminal 1 in such a manner that the conductor 41 is opposed to the bottom plate portion 3. Thereafter, the FPC 40 is pressed toward the bottom plate portion 3, so that the barrels 4 pierce the base sheet 42 in the direction of the thickness thereof, and project upwardly from the base sheet 42 to be arranged along the conductor 41. Then, the barrels 4 are bent and folded inwardly relative to the bottom plate portion 3, so that the FPC 40 is held between each barrel 4 and the bottom plate portion 3, thereby effecting the connection. In this condition, each of the spring piece portions 6 is resiliently contacted with the FPC 40 with a predetermined load, and the projection 7 on the spring piece portion 6 is contacted with the conductor 41 with an appropriate resilient force, and therefore the FPC 40 is always kept electrically connected to the flat cable terminal 1 in a good condition. And besides, even when an external tensile stress acts on the FPC 40, the FPC 40 will not be withdrawn from the terminal 1 since the barrels 4 piece a plurality of portions of the base sheet 42, respectively. Therefore, the FPC is also positively mechanically connected to the terminal.

The flat cable terminal 1 has the spring piece portions 6, and therefore even when the conductor 41 and the base sheet 42 are changed in thickness, the pressing force of the barrels 4 can always achieve the good contacted condition, so that the press-contact of the barrels with the FPC 40 can be made stable. Therefore, it is not necessary to press the barrels against the FPC 40 hard enough to break the FPC 40, and besides the shape of bending of the barrels 4 can be easily controlled.

The fine projection 7 is formed on the spring piece portion 6, and therefore the terminal can be positively contacted with the conductor 41 even if the spring piece portions 6 and the barrels 4 are not always parallel with each other.

The distal end portion of the FPC 40 does not need to be processed into juxtaposed rectangular sections, and therefore the terminal-connecting operation can be simplified.

The chamfered, slanting piercing surface 5 is formed at the distal end of the barrel 4, and the barrel 4 has a substantially parabolic shape in its developed condition. With this design, the barrel 4 can easily pierce the base sheet 42, and therefore the terminal-connecting operation can be carried out more easily.

In the above embodiment, although the FPC 40 is used as the flat cable, the flat cable, to which the flat cable terminal of the present invention is applied, is not limited to such FPC. For example, the terminal can be applied to a so-called flexible flat cable (FFC) having metal conductors formed on an insulative base sheet by an adhesive or the like.

In the above embodiment, the barrels, formed on the opposite side edges of the bottom plate portion, are arranged in a staggered manner (that is, the barrels on the right side edge and the barrels on the left side edge are arranged alternately) in the longitudinal direction. However, the barrels can be arranged in any other suitable staggered fashion, and for example, pairs of barrels on the right side edge of the bottom plate portion can be disposed alternately with pairs of barrels on the left side edge.

In the above embodiment, although the barrel 4 has a substantially parabolic shape in its developed condition, the object of the present invention can be achieved even if the barrel has any other suitable shape such as a semi-circular shape and a triangular shape.

As described above, the flat cable terminal of the present invention is connected to the flat cable by causing the barrels to pierce the flat cable, and therefore the processing of the distal end portion of the cable is omitted, and the efficiency of the cable-connecting operation can be enhanced. And besides, the terminal has the spring piece portions and the fine projections, and therefore even when the thickness of the flat cable is changed, the pressing force of the barrels obviates the need for the strict control of the bent condition and shape of the barrels, so that the good contacted condition can always be attained, thus achieving versatility. Furthermore, the flat cable terminal can be electrically and mechanically connected to the flat cable in a good condition.

What is claimed is:

1. A terminal, comprising:

a bottom plate portion onto which a flat cable is attachable at least one barrel formed on the bottom plate portion and at least one resilient piece portion resiliently deformable on the bottom plate portion wherein the bottom plate portion is partially cut to form the at least one resilient piece portion, wherein the at least one resilient piece portion is upwardly raised relative to the bottom plate portion, wherein the at least one barrel pierces a base sheet of the flat cable in a thickness direction thereof, and is so folded that a conductor formed on the base sheet of the flat cable is pressed and held between the at least one barrel and the at least one resilient piece portion, and wherein a projection is formed on the upper face of the at least one resilient piece portion in order to firmly press against the conductor of the flat cable.

2. The terminal of claim 1, wherein a distal end of the at least one barrel is chamfered so as to facilitate penetration of the at least one barrel relative to the base sheet of the flat cable.

3. The terminal of claim 1, wherein the at least one barrel has a substantially parabolic shape.

4. The terminal of claim 1, wherein the flat cable is held between the at least one barrel and the at least one resilient piece portion, so that the at least one resilient piece portion is electrically connected to the conductor of the flat cable.

5. The terminal of claim 1, wherein the conductor of the flat cable is arranged along a longitudinal direction of the bottom plate portion.

6. The terminal of claim 1, wherein the at least one resilient piece portion is disposed correspondingly to the at least one barrel.

7. The terminal of claim 1, wherein a proximal end of the at least one resilient piece portion is located adjacent to a proximal end of the at least one barrel.

8. The terminal of claims 1, wherein the at least one resilient piece portion is formed on the bottom plate portion in a cantilever manner.

9. The terminal of claim 1, further comprising a terminal body, and a terminal portion formed at a first end portion of the terminal body, wherein the bottom plate portion is formed at a second end portion of the terminal body.

10. The terminal of claim 1, wherein the plurality of barrels are arranged on opposite side edges of the bottom plate portion in a staggered manner, and wherein the plurality of resilient piece portions are disposed correspongly to the plurality of barrels, respectively.

11. The terminal of claim 10, wherein proximal ends of the plurality of resilient piece portions are respectively located adjacent to proximal ends of the plurality of barrels.

12. A terminal, comprising:

a bottom plate portion onto which a flat cable is attachable;

a plurality of barrels formed on the bottom plate portion; and a plurality of resilient piece portions resiliently deformable on the bottom plate portion, wherein the bottom plate portion is partially cut to form the plurality of resilient piece portions, wherein the plurality of resilient piece portions is upwardly raised relative to the bottom plate portion, wherein the plurality of barrels pierce a base sheet of the flat cable in a thickness direction thereof, and are so folded that a conductor formed on the base sheet of the flat cable is pressed and held between the plurality of barrels and the plurality of resilient piece portions, and wherein a proximal end of each of the plurality of resilient piece portions is connected to the same side of a cut away in the bottom plate portion as the nearest barrel to the resilient piece portion.

13. The terminal of claim 12, wherein a distal end of each of the plurality of barrels is chamfered so as to facilitate penetration of the plurality of barrels relative to the base sheet of the flat cable.

14. The terminal of claim 12, wherein each of the plurality of barrels has a substantially parabolic shape.

15. The terminal of claim 12, wherein the flat cable is held between the plurality of barrels and the plurality of resilient piece portions, so that the plurality of resilient piece portions is electrically connected to the conductor of the flat cable.

16. The terminal of claim 12, wherein the conductor of the flat cable is arranged along a longitudinal direction of the bottom plate portion.

17. The terminal of claim 12, wherein the plurality of resilient piece portions is disposed correspondingly to the plurality of barrels.

18. The terminal of claim 12, wherein the plurality of resilient piece portions is formed on the bottom plate portion in a cantilever manner.

19. The terminal of claim 12, further comprising a terminal body, and a terminal portion formed at a first end portion of the terminal body, wherein the bottom plate portion is formed at a second end portion of the terminal body.

20. The terminal of claim 12, wherein the plurality of barrels are arranged on opposite side edges of the bottom plate portion in a staggered manner, and wherein the plurality of resilient piece portions is disposed correspondingly to the plurality of barrels, respectively.

* * * * *